US005454288A

United States Patent [19]

Hoshino

[11] Patent Number: 5,454,288

[45] Date of Patent: Oct. 3, 1995

[54] DRUM HOLDER WITH DRUM HOOP ATTACHMENT

[75] Inventor: Yoshiki Hoshino, Aichi, Japan

[73] Assignee: Hoshino Gakki Co., Ltd., Japan

[21] Appl. No.: 214,781

[22] Filed: Mar. 16, 1994

[30] Foreign Application Priority Data

Jan. 14, 1994 [JP] Japan ..... 6-015975

[51] Int. Cl.[6] ..... G10D 13/02

[52] U.S. Cl. ..... 84/421; 248/635

[58] Field of Search ..... 84/411 R, 411 A, 84/421; 248/635, 636, 638

[56] References Cited

U.S. PATENT DOCUMENTS 4,158,980 6/1979 Gauger ..... 84/421

5,104,271 4/1992 Lechler ..... 248/635 X

*Primary Examiner*—Steven L. Stephan
*Assistant Examiner*—Patrick J. Stanzione
*Attorney, Agent, or Firm*—Ostrolenk, Faber, Gerb & Soffen

[57] ABSTRACT

A drum holder for a drum having a drum hoop around the upper part of the drum body. The drum hoop having three first flanges, each with a first installation hole. A bracket with side arms and having three corresponding second flanges each with a second installation hole. The first and second flanges are overlapped. A vibration absorbing bolt extends into each set of aligned first and second holes with a vibration absorbing material part at one side of the flanges and a nut for being tightened on the bolt at the other side of the flanges. A support plate supports the side arms of the bracket and the support plate is in turn supported on a support for the drum.

22 Claims, 5 Drawing Sheets

FIG. 2
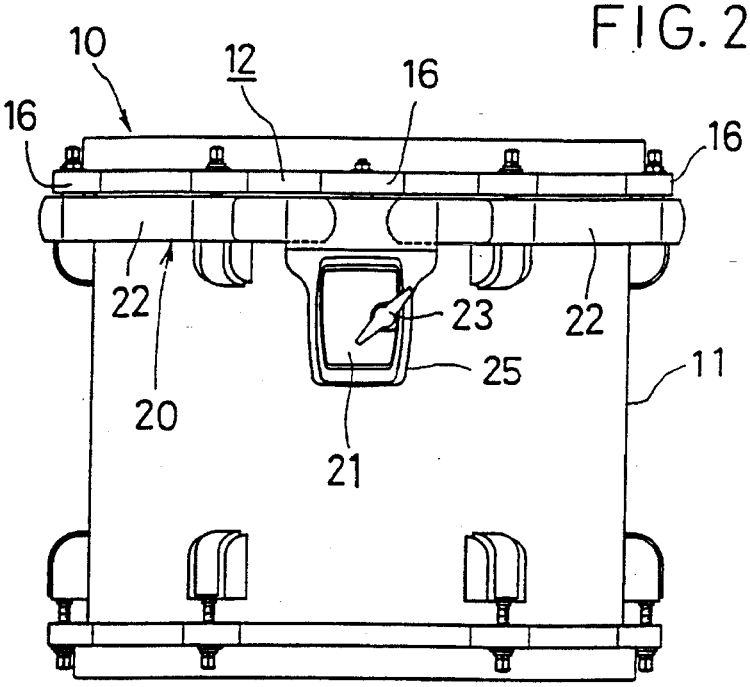
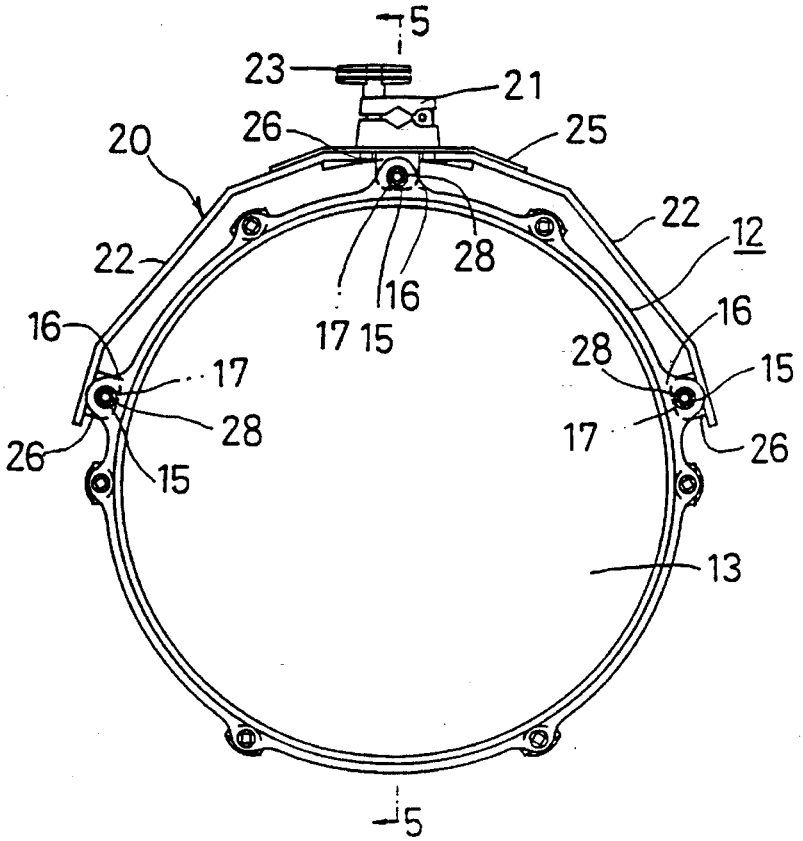
FIG. 3

DRUM HOLDER WITH DRUM HOOP ATTACHMENT

BACKGROUND OF THE INVENTION

The present invention relates to a drum holder which is capable of supporting a musical instrument drum without interfering with the sound effect produced by the drum.

THE PRIOR ART

An example of a prior art drum holder for a medium size drum, called a tom-tom, is shown in FIG. 7. The medium size drum 70 includes a drum body 71, a bracket 72 to be attached to the body, an array of lugs 73 around the body toward the top and bottom ends for attachment thereto of drum heads, a drum holding rod 74 and a holding stand 75 for the rod.

The bracket 72 is installed at one side of and toward the center of the drum body 71. The bracket is fixed to a holding stand 75 by a bolt 76 through a drum holding rod 74 which has been inserted into the bracket 72. This design has the drawback that the entire weight of the drum 70 is supported at the bracket installation location along the drum body 71. This causes local strains and twists on the body 71 during the long periods of time when it is used.

Such strains interfere with the uniform and effective vibration of the drum body, thereby making impossible the maximum use of the sounds of the drum body cause by beating.

To improve this, the present inventor had earlier proposed a drum support comprising a support plate having an installation part which is applied to the top and bottom hoops of the drum body and a bracket on the support plate. Since the bracket and the drum body do not contact each other, it is possible to prevent interference with the vibrations of the drum body. However, because the weight of the drum is added locally to the installation part of the drum hoops, twists have been produced at such parts. Because the beating sound of the drum is produced as the result of the resonance of the drum body, the drum head, the drum hoops, the drum lugs, etc., it is desirable to prevent such twists or strains in parts other than the body.

Sometimes the vibration energy produced during beating of the drum is transmitted to the drum stand through the bracket or the tom-holder and this may move the stand or loosen the tightened bolt of the bracket or tom-holder during the performance.

In view of the above, there has been a need for a drum support which does not transmit the aforementioned energy to the stand side but which is capable of effectively vibrating the drum itself.

Another design for supporting a drum body is shown in U.S. Pat. No. 4,158,980. A drum support bracket in the form of a partial circular ring extends around the drum body near the top end but below the hoop which holds the drum head on the drum body. This support bracket engages three of the drum lugs which are located on the drum body and to which the drum hoop is secured by lug bolts. Stress on the lugs from beating on the drum, which shifts or vibrates the drum relative to the bracket, may cause the lugs to tear free of the drum body or to deform it due to the concentration of stress at the lugs, and the invention seeks to avoid that.

SUMMARY OF THE INVENTION

The present invention is intended to solve the aforementioned problems through a drum holder which flexibly and accurately supports the drum without producing any local strains or twists in the drum and which prevents the transmission of vibrations of the drum to the drum support or stand, thereby enabling the intrinsic resonant function of the drum to be realized to a maximum extent.

The drum holder of the invention supports the drum at the upper drum hoop. A plurality of first installation elements in the form of first flanges is defined on the hoop, and each first flange is provided with a respective installation hole. A bracket includes a central plate which is supported by a drum support and includes two outwardly extending arms which partially wrap around the drum body at the hoop. The drum holder bracket has respective second installation elements in the form of second flanges on the bracket interior side which are provided at respective locations which correspond to the hoop side first installation elements or flanges on the support member. The first and second sets of installation flanges are secured together through respective installation bolts having a vibration absorbing part comprised of a vibration absorbing material.

Other objects and features of the invention are explained below with reference to the attached drawings.

BRIEF DESCRIPTION OF THE DRAWINGS

FIG. 2 is a view in the direction indicated by the arrow 2 in FIG. 1;

FIG. 3 is a top view in the direction of arrow 3 in FIG. 1;

DESCRIPTION OF A PREFERRED EMBODIMENT

Figure 1:
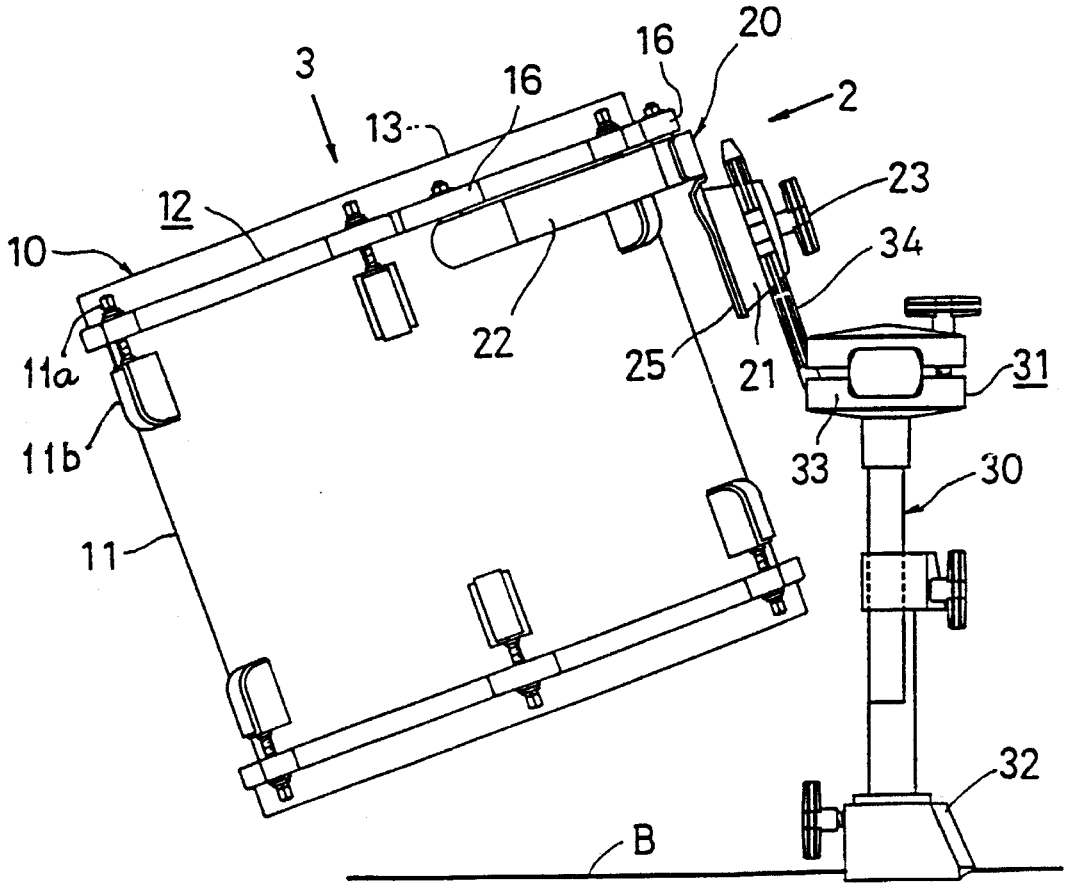
FIG. 1 is a side view of a medium size drum supported by a support according to the invention.

In FIGS. 1 through 3, the support structure of the invention flexibly supports a drum 10, such as a medium size drum, at a drum support 30 through a drum holder 20 according to the invention. The drum 10 includes a plurality of lugs **11*a* and cooperating castings 11*b* formed at spaced locations on the drum body 11. The lugs 11*a* are threadedly and adjustably engaged in the castings 11*b* to tune the drum 10, as is conventional. In this example, the drum support 30 is a known tom holder 31 which may be fixed to a bass drum at B through a tom holder base 32. Alternately, a floor setting stand can be used in place of the drum holder 30**.

A drum support rod 34 is tightly fixed to the tom holder 31 by a clamp 33, and the drum holder 20 is provided on the drum support rod 34.

Figure 4:
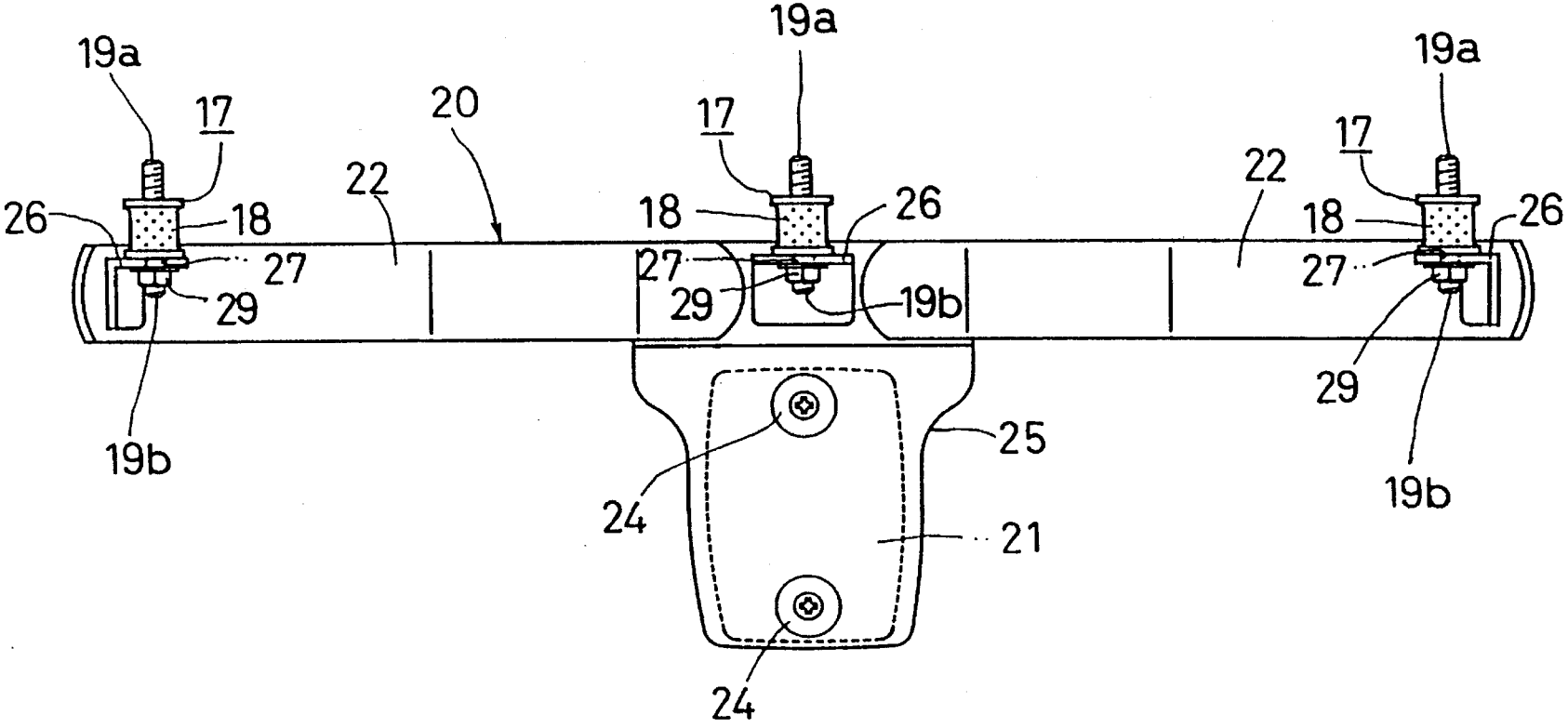
FIG. 4 is a front view of the support member.
Figure 5:
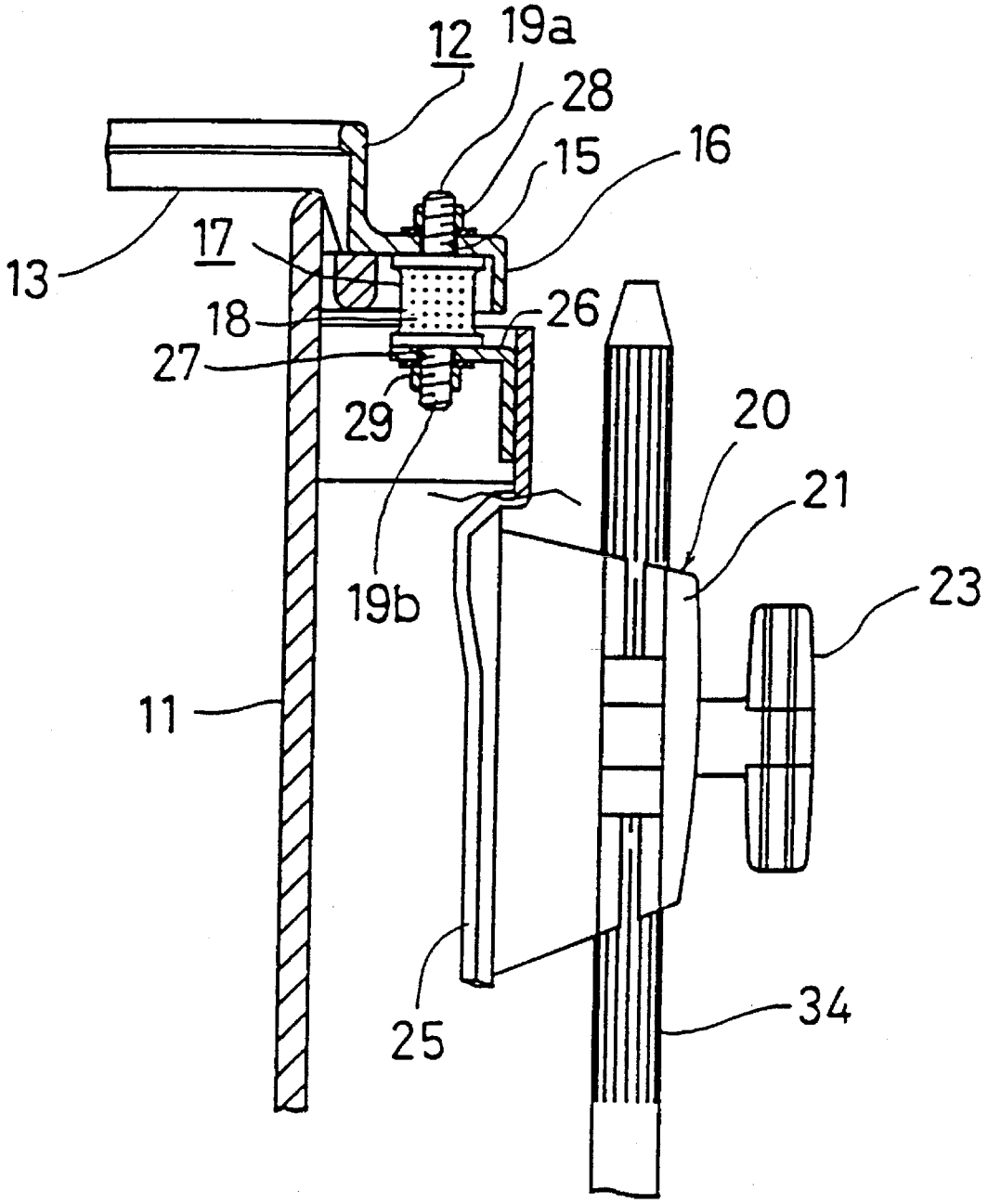
FIG. 5 is an expanded cross section along line 5—5 in FIG. 3.

The holder 20 includes a bracket 21 which supports laterally outstretched, circumferential arms 22 which together encircle part of the circumference of the drum body 11, so that, as seen in FIG. 4, the holder 20 is generally T-shaped when viewed from the front.

The bracket 21 is for installing the drum holder 20 on the support 30. The support bracket is fixed to the bracket installation plate 25 by a bracket installation screw 24. The bracket 21 is supported on the drum support 30 at one end of the drum support rod 34. A tightening bolt 23 secures the bracket on the rod 34.

The arms 22 extend out from the plate at the center of the bracket and each arm is curved to surround part of the outer periphery of the drum body 11 of the drum 10. The arms are fixed at the right and left of the top of the installation plate 25 by being either welded or screwed to it. The arms 22 are located at and just below the outer periphery of the top side drum hoop 12 of the drum 10.

The drum hoop 12 at the top side of the drum body conventionally tightens the top side drum head 13 over the open top end of the drum body 11. A plurality of at least three first installation flanges 16 are formed at circumferentially spaced intervals on the hoop outer side and extend out to the bracket arms 22. Each flange 16 has a vertical bolt installation hole 15 passed through it.

The installation flanges 16 support the drum 10 to the drum holder 20 as the drum is installed on the first flanges 16 with installation bolts 17. The flanges 16 prevent development of any strains on the drum body because they diffuse the weight of the drum 10 by supporting the drum 10 at a plurality of widely spaced apart positions around the drum body. It is desirable that the flanges 16 and installation holes 15 be widely dispersed around the top drum hoop 12 for providing stable support for the drum. There may be more than three flange locations, selected depending upon the size and weight of the drum.

The circumferential lengths of the arms 22 is determined in consideration of the size of the drum 10 to be supported. For supporting the drum in a stable fashion, however, the arm lengths are selected so that the arms together surround approximately half the drum body 11. In this connection, arms 22 can be constituted of one single plate body.

A respective short circumferential length second support flange 26 is either welded or screwed, at a circumferential location corresponding to each hoop side first flange 16, on the inner side of each arm 22 and on the installation plate 25 of the holder 20. The respective first and second flanges 16 and 26 are overlapped.

Each overlapped hoop side flange 16 and the respective support member side installation flange 26 are secured together with a respective installation bolt 17. The drum body is supported to be embraced from outside by the arms 22 of the support member 20. Accordingly, the stability of the drum is satisfactory.

Each installation bolt 17 elastically links the flanges 16 and 26, and each has a vibration absorbing part 18 made of a vibration absorbing material disposed above the flange 16 and in contact with it. The vibration absorbing part 18 effectively vibrates and resonates the drum by absorbing the vibrations of the drum caused by its being beaten. Either hard or soft rubber, foam or an elastic material is preferably used as the vibration absorbing material. By providing the vibration absorbing parts 18 of selected shapes, materials and hardnesses which are different and setting them in such a way that the rate of the vibration transmission, as compared with the impact of the beatings and the weight and size of the drums, may become small, it is possible to obtain a vibration prevention effect even when there are a plurality of drums.

Figure 6:
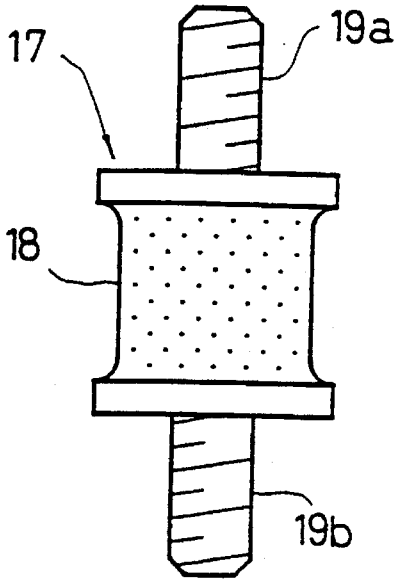
FIG. 6 is an elevational view of an example of the installation bolt.
Figure 7:
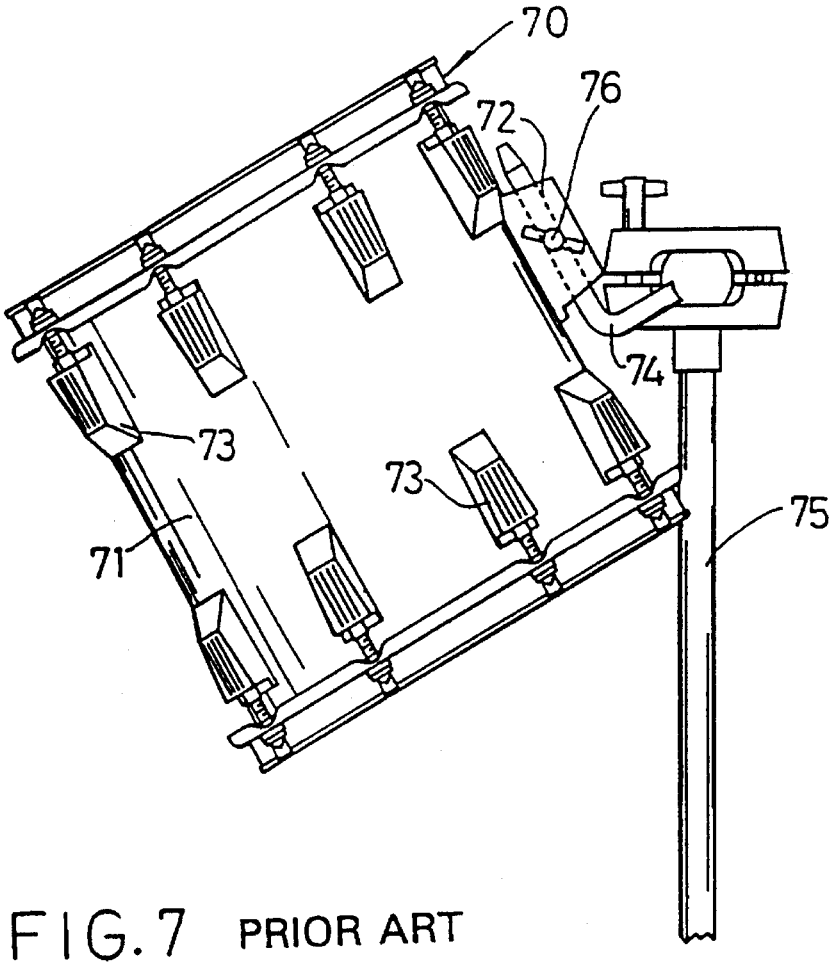
FIG. 7 PRIOR ART
FIG. 7 is a side view of a medium size drum supported by a drum support structure according to prior art.

As is shown in FIG. 6, the installation bolt 17 is a known vibration absorbing rubber structure with threaded bolt shanks 19*a* and 19*b* projecting from its top and bottom ends. The upper bolt shank 19*a* is inserted into the installation hole 15 of the first hoop side installation flange 16 and the lower bolt shank 19*b* which is inserted into the installation hole 27 of the second support member side installation flange 26. The nuts 28 and 29 are tightened from above and below respectively onto the respective bolt shanks 19*a* and 19*b*, which presses together the flanges 16 and 26, the vibration absorbing material 18 and therefore the support 20 and the drum 10.

Assembly and dismantling of the drum 10 and the drum holder 20 can be easily and accurately carried out by installing and removing the upper nut 28 on the installation bolt 17.

The invention diffuses the weight of the drum so that the drum becomes extremely stable because it is supported by a plurality of supporting elements in the form of flanges. The vibration energy of the drum which is generated by beating on the drum head is accurately absorbed by the vibration absorbing part. The vibration energy is therefore not transmitted to the drum holder 20 or the drum support 30. As a result, such vibration energy is used for effective vibration of the drum as a whole and for the resonance of the beating sound.

In view of the fact that the vibration absorbing part is elastically deformed by the weight of the drum and the impact of beating on the drum, and because it flexibly supports the drum, local strains will not be produced in the drum body or in the drum head, so that the drum beating performance can be carried out with satisfactory sound quality at all times.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A drum holder for supporting a drum at its drum hoop, wherein:

the drum comprises a drum body with an open end, a drum head over the open end of the drum body, a hoop around the drum body engaging the drum head and holding the drum head securely over the open end of the drum body;

the drum holder comprising:

a plurality of first installation elements on the drum hoop at locations spaced apart from each other and arrayed partially around the hoop;

a bracket extending partially around the drum body and including a plurality of second installation elements on the bracket, each positioned for engaging a respective one of the first installation elements on the hoop;

respective vibration absorbing means attaching the bracket to the hoop at the first and second installation elements so that the hoop is fixed at a stationary position relative to the bracket, the vibration absorbing means being adapted for absorbing vibration of the drum transmitted through the hoop;

a drum support attached to the bracket for supporting the bracket and the drum.

2. The drum holder of claim 1, wherein the bracket comprises a plate to which the drum support is attached and comprises arms projecting laterally from the plate partially around the hoop with some of the second installation elements being on the arms of the bracket.

3. The drum holder of claim 2, wherein one of the second installation elements is on the plate of the bracket.

4. The drum holder of claim 2, wherein the bracket plate is located below the hoop and below the arms of the bracket along the drum body, and the hoop having the first installation elements thereon is located toward the top of the drum body.

5. The drum holder of claim 1, wherein each first installation element comprises a first flange on the hoop, and each second installation element comprises a second flange on the bracket; and the absorbing means secures the respective first and second flanges together.

6. The drum holder of claim 5, wherein each second flange on the bracket overlaps the respective first flange on the hoop;

each first flange on the hoop defines a respective first installation hole, and each second flange on the bracket defines a second installation hole aligned with the first installation hole on the respective overlapped first flange;

the vibration absorbing means comprising a respective bolt having a vibration absorbing part and extending into the respective first and second holes in the first and second flanges.

7. The drum holder of claim 6, wherein the bracket comprises a plate to which the drum support is attached and comprises arms projecting laterally from the plate partially around the hoop with some of the second installation elements being on the arms of the bracket.

8. The drum holder of claim 7, wherein each of the arms has an end away from the plate; a respective first flange toward the end of each arm and another first flange at the plate.

9. The drum holder of claim 8, including three of the first installation flanges on the hoop.

10. The drum holder of claim 6, wherein each of the bolts comprises a vibration absorbing part comprised of a vibration absorbent material.

11. The drum holder of claim 10, wherein the bolt is comprised of a vibration absorbing rubber structure.

12. The drum holder of claim 10, wherein the bolt has a protruding bolt shank which protrudes through the first and second installation holes, and a nut tightened over the shank;

the vibration absorbing part of the bolt being on the side of the first and second flanges away from the nut, the nut being tightenable onto the bolt shank for securing the flanges between the nut and the vibration absorbing part.

13. A supporting apparatus for supporting a drum, the drum including a drum head, a circumferential shell, a plurality of castings disposed at spaced locations on the circumferential shell, a drum hoop surrounding the circumferential shell and receiving a plurality of lugs for cooperating with the plurality of castings to tighten the drum head;

the supporting apparatus comprising:

a plurality of first support members disposed at spaced locations along a portion of the drum hoop;

a support bracket partially surrounding the circumferential shell and having a plurality of second support members disposed at spaced locations along the support bracket, each of the second support members being aligned with a respective first support member so that respective first and second support members can be secured to each other;

a plurality of fixing members for fixedly securing respective first and second support members to each other to prevent the respective first and second support members from moving relative to each other; and a drum support attached to the bracket for supporting the bracket and the drum.

14. The apparatus of claim 13, wherein each of said fixing members comprises a vibration absorbing portion and a threaded shaft extending through the vibration absorbing portion so that the threaded shaft is exposed at either end of the vibration absorbing portion and a nut located at each end of the threaded shaft so that each of the first and second support members are located between the nut and the vibration absorbing portion.

15. The apparatus of claim 13, wherein the first support members are separated from and located spaced away from the plurality of castings and the plurality of lugs.

16. The apparatus of claim 13, wherein the bracket comprises a plate to which the drum support is attached, wherein at least one of the second support members is located on said plate.

17. The apparatus of claim 13, wherein each of the fixing members includes a vibration absorbing portion having an upper portion and a lower portion, the upper portion contacting one of the first support members and the lower portion contacting one of the second support members.

18. The apparatus of claim 13, wherein each of the fixing members includes a vibration absorbing portion arranged to contact respective first and second support members to absorb vibration energy produced by the drum to thereby prevent the vibration energy from being transmitted to the support bracket and the drum support.

19. The apparatus of claim 13, wherein each of the first and second support members has a hole formed therein, the holes of respective first and second support members being aligned with each other, each of the fixing members having a threaded shaft for protruding through the holes in the first and second support members and including a plurality of nuts threadedly engaged on the shaft so that each of the first and second supporting members are located between one of the nuts and the vibration absorbing portion.

20. The apparatus of claim 13, wherein each of the fixing members includes a threaded shaft, the threaded shaft being engaged in respective first and second support members without contacting the plurality of castings formed on the circumferential shell of the drum.

21. A supporting apparatus for supporting a drum, the drum including a drum head, a circumferential shell, a plurality of castings disposed at spaced locations on the circumferential shell, a drum hoop surrounding the circumferential shell and receiving a plurality of lugs for cooperating with the plurality of castings to tighten the drum head;

the supporting apparatus comprising:

a plurality of first support members disposed at spaced locations along a portion of the drum hoop, the first support members being separated from the castings and the lugs;

a support bracket partially surrounding the circumferential shell and having a plurality of second support members disposed at spaced locations along the support bracket, each of the second support members being aligned with a respective first support member so that respective first and second support members can be secured to each other;

a plurality of fixing members for fixedly securing respective first and second support members to each other to prevent the respective first and second support members from moving relative to each other, and a drum support attached to the bracket for supporting the bracket and the drum.

22. A supporting apparatus for supporting a drum, the drum including a drum head, a circumferential shell, a plurality of castings disposed at spaced locations on the circumferential shell, a drum hoop surrounding the circumferential shell and receiving a plurality of lugs for cooperating with the plurality of castings to tighten the drum head;

the supporting apparatus comprising:

a plurality of first support members disposed at spaced locations along a portion of the drum hoop;

a support bracket partially surrounding the circumferential shell and having a plurality of second support members disposed at spaced locations along the support bracket, a plurality of fixing members for fixedly securing respective first and second support members to each other to prevent the respective first and second support members from moving relative to each other, each of the fixing members including a threaded shaft arranged to be engaged in respective first and second support members without contacting the plurality of castings formed on the circumferential shell of the drum; and a drum support attached to the bracket for supporting the bracket and the drum.

* * * * *